US012078437B2

(12) United States Patent
Featherston, Jr.

(10) Patent No.: US 12,078,437 B2
(45) **Date of Patent: *Sep. 3, 2024**

(54) MAGNETIC GUN MOUNT

(71) Applicant: AnP Designs, LLC, Sachse, TX (US)

(72) Inventor: Ronald Eugene Featherston, Jr., Sachse, TX (US)

(73) Assignee: AnP Designs, LLC, Sachse, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/351,379

(22) Filed: Jul. 12, 2023

(65) Prior Publication Data

US 2024/0027160 A1 Jan. 25, 2024

Related U.S. Application Data

(63) Continuation of application No. 17/697,149, filed on Mar. 17, 2022, now Pat. No. 11,740,048.

(60) Provisional application No. 63/162,808, filed on Mar. 18, 2021.

(51) Int. Cl.
*F41C 27/00* (2006.01)
*F41A 23/18* (2006.01)

(52) U.S. Cl.
CPC ..... *F41A 23/18* (2013.01)

(58) Field of Classification Search
CPC ..... F41A 3/72; F41A 23/18
See application file for complete search history.

(56) References Cited

U.S. PATENT DOCUMENTS

| | | | | | |
|---|---|---|---|---|---|
| 4,043,065 | A * | 8/1977 | Musgrave | F41A 19/34 | 42/106 |
| 5,467,909 | A * | 11/1995 | Resca | F41C 33/0245 | 224/198 |
| 5,611,164 | A * | 3/1997 | Rassias | F41C 33/0245 | 42/51 |
| 9,121,662 | B1 * | 9/2015 | Love | F41C 27/00 | |
| 9,194,636 | B2 | 11/2015 | McAninch | | |
| 9,360,273 | B1 * | 6/2016 | Steinbock | F41A 23/18 | |
| 9,500,439 | B1 * | 11/2016 | Dietrich | F41A 3/72 | |
| 9,733,043 | B1 * | 8/2017 | Cohen | F41A 3/72 | |
| 9,995,544 | B1 * | 6/2018 | Akimov | F41A 3/72 | |
| D896,912 | S * | 9/2020 | Fournet | D22/108 | |
| D923,132 | S * | 6/2021 | Wang | D22/109 | |
| 2007/0138219 | A1 * | 6/2007 | Kovalchuk | F41C 33/0281 | 224/912 |
| 2007/0163164 | A1 * | 7/2007 | Avrahami | F41C 33/04 | 42/87 |

(Continued)

*Primary Examiner* — Derrick R Morgan
(74) *Attorney, Agent, or Firm* — Fish & Richardson P.C.

(57) ABSTRACT

This disclosure describes a system, and apparatus for securely mounting a firearm, while maintaining to ability to load, unload, and draw the firearm from the mount with a single hand. This is accomplished using a mount that is customized to conform to a specific model of firearm, ensuring a snug fit of the firearm within the mount. Magnetic retention secures the firearm in place in the mount. Modern, magazine fed handguns can be loaded and unloaded simply by moving the slide. Cycling the slide causes it to extract a round from the chamber (if a round is present) when the slide traverses rearward relative to the receiver. A new round is loaded from the magazine when the slide traverses forward relative to the receiver (if a loaded magazine is inserted).

11 Claims, 5 Drawing Sheets

(56) References Cited

U.S. PATENT DOCUMENTS

| | | | | |
|---|---|---|---|---|
| 2013/0255478 | A1* | 10/2013 | McAninch | F41A 19/52 89/1.4 |
| 2015/0014499 | A1* | 1/2015 | Mantua | F16M 13/00 248/314 |
| 2015/0184959 | A1* | 7/2015 | Parnell | F41A 3/72 89/1.4 |
| 2015/0377578 | A1* | 12/2015 | Tucker | F41A 23/18 248/316.1 |
| 2018/0003461 | A1* | 1/2018 | Higgins | B23P 13/00 |
| 2019/0072357 | A1* | 3/2019 | Couie | A47B 81/005 |
| 2020/0049444 | A1* | 2/2020 | Cerda | B60R 7/14 |
| 2021/0372728 | A1* | 12/2021 | Cerda | F41A 23/18 |

* cited by examiner

MAGNETIC GUN MOUNT

CLAIM OF PRIORITY

This application is a continuation of U.S. application Ser. No. 17/697,149, filed Mar. 17, 2022, which claims priority under 35 USC § 119 to U.S. Application Ser. No. 63/162,808, filed on Mar. 18, 2021, and each application is hereby incorporated by reference in its entirety.

BACKGROUND

Firearm holsters and mounts serve two functions. Firstly, they must securely and safely retain the firearm. Secondly, they must provide ready access to the weapon for use. Often these two function are a balancing act, where increased security and safety comes at the cost of ready access.

SUMMARY

The present disclosure involves systems, methods, and an apparatus for mounting a firearm. The firearm mount comprises a block that defines a recess, the recess configured to receive a slide portion of a firearm and being opposite a mounting surface of the block. A slot is also defined by the block at a distal end and sized to receive a barrel of the firearm while retaining the slide portion of the firearm when the firearm translates towards the slot. The block further defines an ejection window on a side of the block, the ejection window sized so that a chambered round is ejected from the firearm and the block when the firearm translates toward the distal end of the block.

Implementations can optionally include one or more of the following features.

In some instances, the recess conforms to a shape of the slide portion of the firearm. In some implementations, the recess conforms within two millimeters to the slide portion of the firearm.

In some instances, the block defines a magnet slot on the mounting surface of the block, the slot configured to receive a magnet.

In some instances, the block defines two or more magnet slots on a side of the block perpendicular to the mounting surface and the slot, the magnet slots configured to receive a magnet.

In some instances, the block comprises a single material and is formed using additive manufacturing. In some instances, the single material is a plastic, polymer, or elastomer.

In some instances, the mounting surface defines holes configured to receive mounting hardware.

In some instances, the block defines a notch within the mounting surface that is configured to receive a front sight of the firearm.

The details of these and other aspects and embodiments of the present disclosure are set forth in the accompanying drawings and the description below. Other features, objects, and advantages of the disclosure will be apparent from the description and drawings, and from the description, drawings, and claims.

DETAILED DESCRIPTION

This disclosure describes a system, and apparatus for securely mounting a firearm, while maintaining to ability to load, unload, and draw the firearm from the mount with a single hand. This is accomplished using a mount that is customized to conform to a specific model of firearm, ensuring a snug fit of the firearm within the mount. Magnetic retention secures the firearm in place in the mount. Modern, magazine fed handguns can be loaded and unloaded simply by moving the slide. Cycling the slide causes it to extract a round from the chamber (if a round is present) when the slide traverses rearward relative to the receiver. A new round is loaded from the magazine when the slide traverses forward relative to the receiver (if a loaded magazine is inserted).

The present solution is advantageous in that it securely mounts a firearm in place, while allowing full cycling of the slide relative to the receiver, and therefore loading and unloading, or chambering and ejecting of a round, while the firearm is held within the mount. Further cycling of the slide, as well as mounting and unmounting (or drawing) the firearm can be completed with a single hand.

Figure 1A:
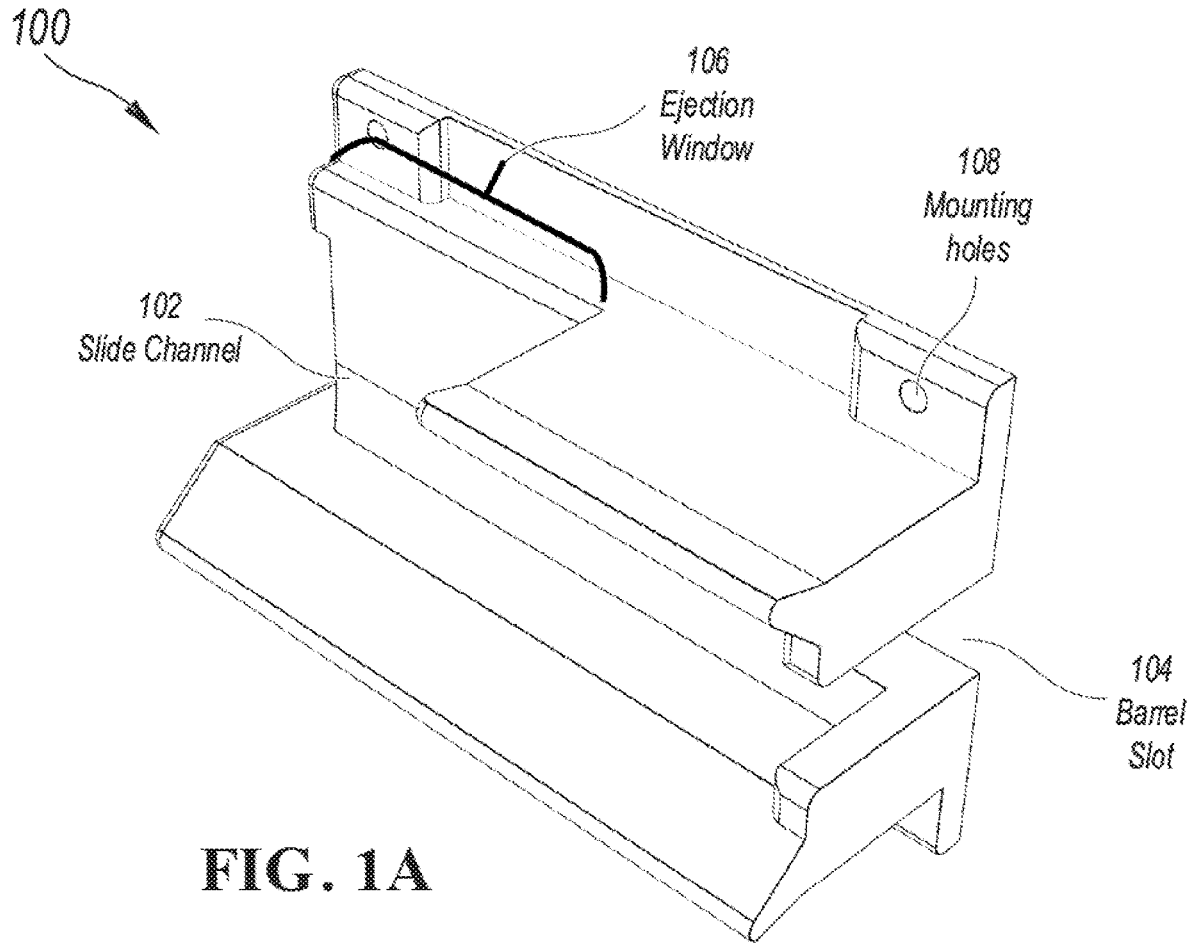
FIGS. 1A and 1B are side perspective views of an example magnetic firearm mount.
Figure 1B:
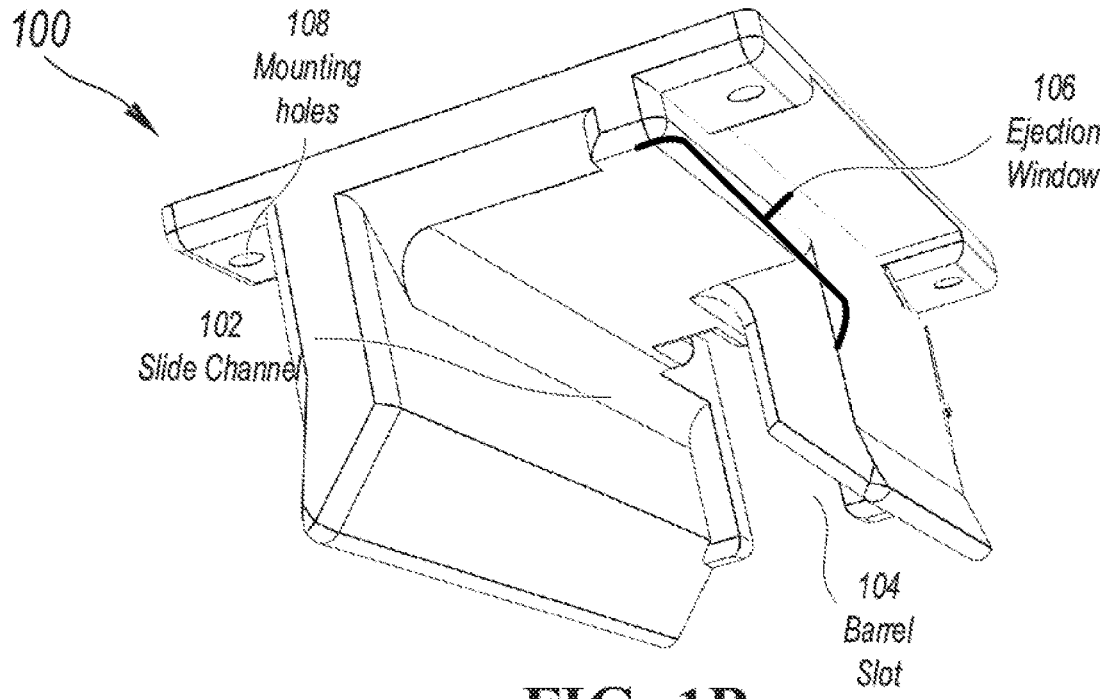

FIGS. 1A and 1B illustrate side perspective views of an example magnetic gun mount. The mount 100 is substantially a block with a slide channel 102 formed in it that is shaped to conform to the slide of a firearm. The slide channel 102 minimizes lateral movement of the firearm and guides the firearm into position against the top of the block. A barrel slot 104 permits the barrel of the firearm to pass through, but not the slide. When the firearm is pressed forward with respect to the mount 100 the slide channel 102 retains the slide, pulling it backwards as the rest of the firearm traverses forward, with the firearm's barrel passing through the barrel slot 104.

Mounting holes 108 can be located near the top or side of the mount 100 and allow the mount to be fastened securely to a surface (e.g., a desk, dashboard, glovebox, wall, etc.). In some implementations, the mount 100 can be mounted using adhesives, screws, nails, or other fastening hardware. In some implementations, the mount has a detachable base, which is configured to be permanently mounted to a surface, and allows the mount to be removably mounted. For example, in some implementations mount 100 slots into a base (not shown) which is screwed into a fixed surface (e.g., a wall, desk, car dash, etc.). A removable base allows different mounts 100 for different firearms to be mounted in the same location without, for example, screwing new hardware into the surface upon which it is mounted.

In some implementations, the mount 100 is configured to conform to and fit within a cup-holder (e.g., in a vehicle), and can be screwed or adhered to the inside of the cup-holder.

Figure 2A:
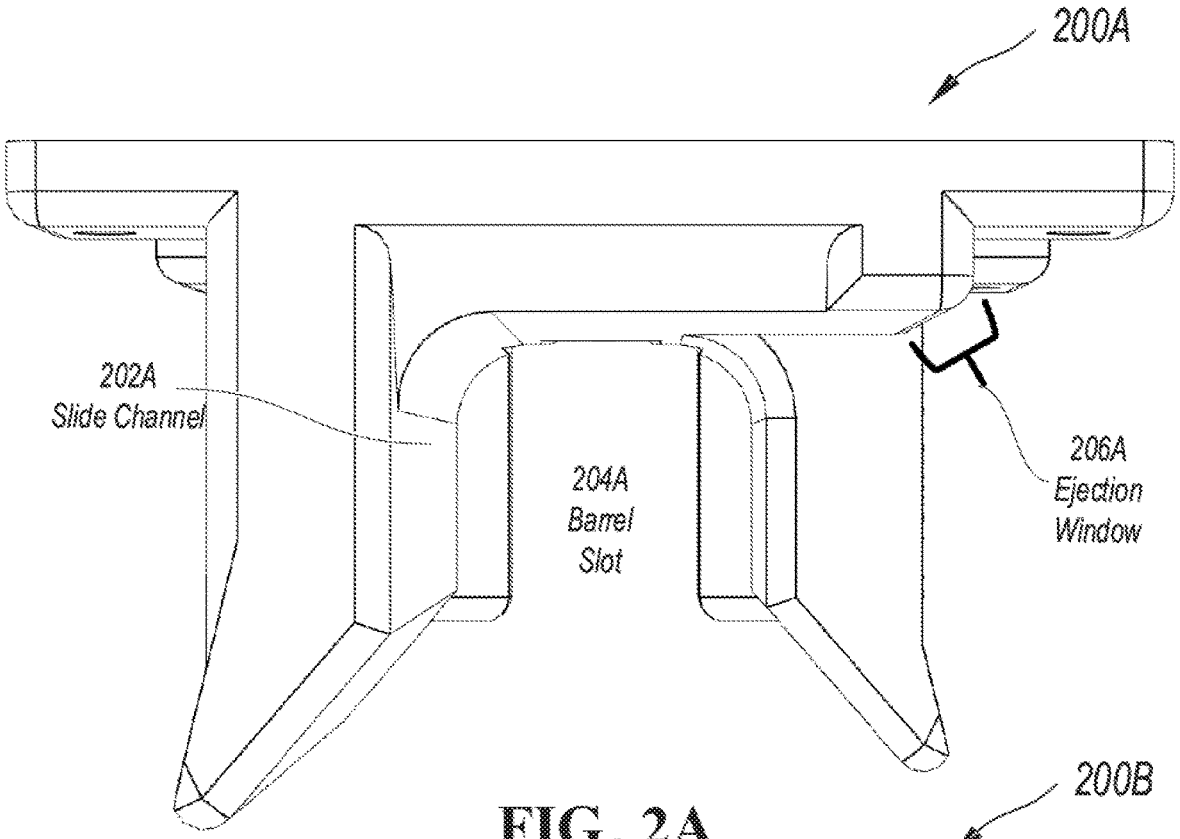
FIGS. 2A and 2B are rear views of example magnetic firearm mounts for different model firearms.
Figure 2B:
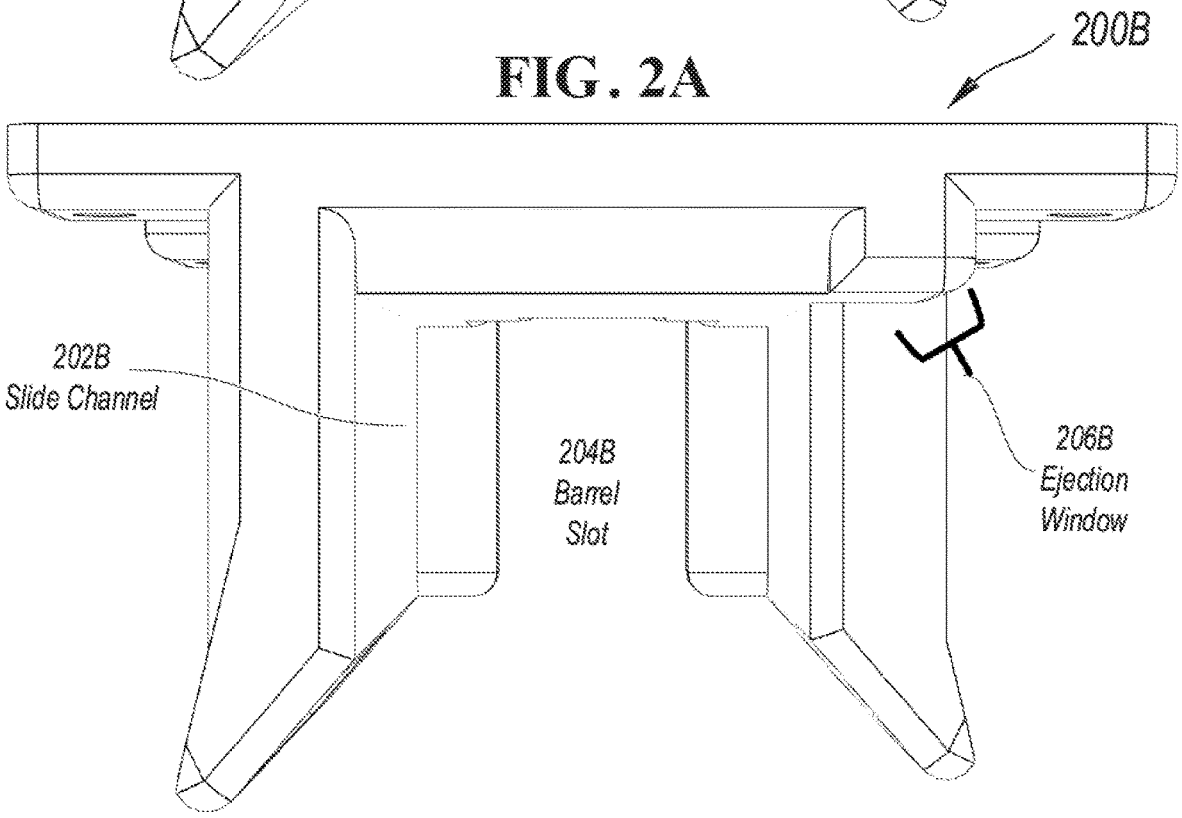

An ejection window 106 is provided in a side of the slide channel 102, which allows chambered rounds to be ejected from the firearm if the slide is cycled while the firearm is in the mount. The size of the ejection window can vary based on the model firearm for which the mount 100 is configured. Slide channel 102 is similarly shaped to fit a specific firearm, and will have a different shape for mounts configured to hold different firearms, as shown in FIGS. 2A and 2B. In some implementations the slide channel 201 extends downward to cover the firearm trigger (not shown). In these implementations, slide channel 201 can prevent operation of the trigger while the firearm is in the mount 100, enhancing safety.

In some implementations, the mount 100 is constructed of a single piece of plastic or polymer, and can be formed using additive manufacturing (e.g., 3D printing) or injection molding. In some implementations, the mount 100 is formed from ABS plastic, Nylon, Acrylic, Polycarbonate, or other elastomer of sufficient strength to securely retain a firearm, and simplicity in manufacture.

Optionally, the mount 100 includes a retention strap (not shown) that can be formed of leather, plastic, rubber, or other suitable material, and ensures the firearm is retained within the mount 100. In some implementations, the retention strap is pivotably affixed to the mount 100, such that a user can apply pressure and rotate the retention strap, allowing the firearm to be withdrawn.

FIGS. 2A and 2B illustrate rear views of example magnetic firearm mounts for different model firearms. Mount 200A is configured for a Smith & Wesson M&P® 45 and features a rounded slide channel 202A and a larger ejection window 206A when compared to mount 200B. Mount 200B is configured for a Glock® 21 and features a more angular, larger slide channel 202B and a shorter ejection window 206B. It should be noted that the barrel slots 204A and 204B are also sized specifically for the particular firearm to be held by the mounts 200A and 200B respectively. Slide channels 202A and 202B are configured to conform to their respective firearms within a tolerance of two millimeters. While two example implementations have been illustrated, it will be clear that a person of ordinary skill in the art can contemplate any number of mounts that are configured to conform to any number of specific firearms (e.g., Glock®19, Sig Sauer® p 365, Springfield® XDS, etc.)

Figure 3A:
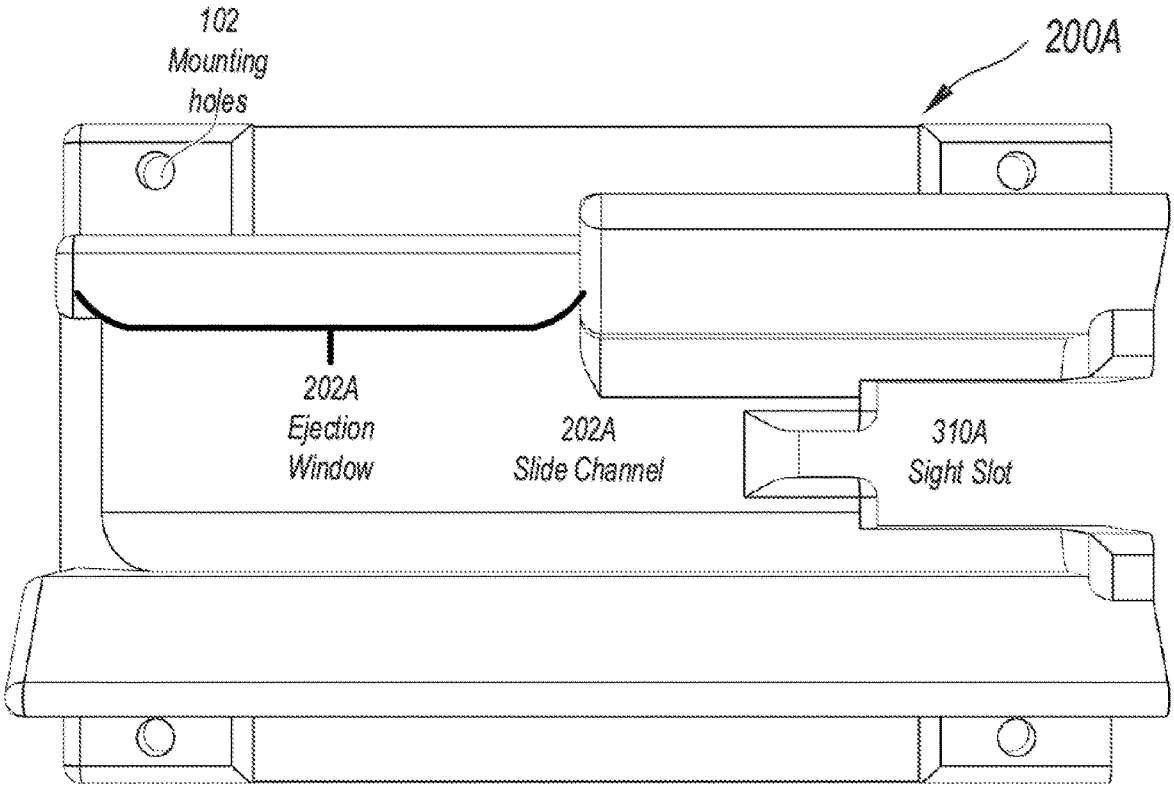
FIGS. 3A and 3B are bottom views of example magnetic firearm mounts for different model firearms.
Figure 3B:
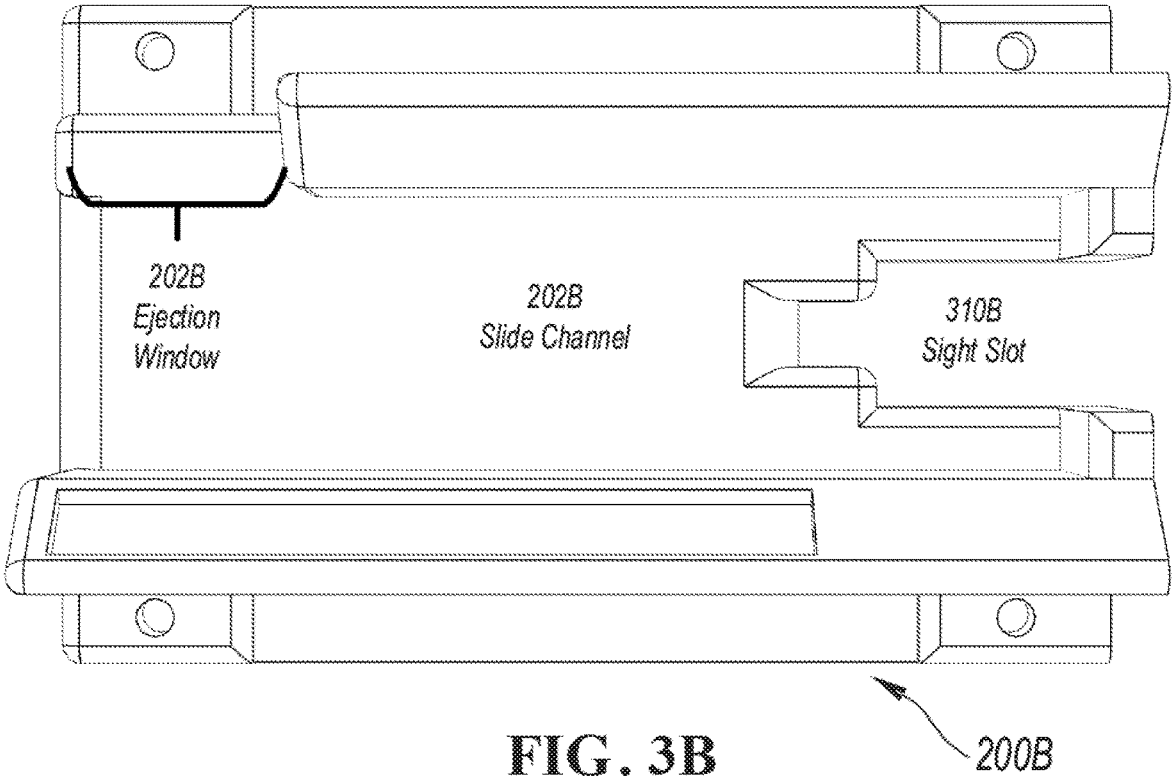

FIGS. 3A and 3B are bottom views of example magnetic firearm mounts for different model firearms. FIGS. 3A and 3B show the difference in size of the ejection windows 202A and 202B based on the necessary clearance for the particular model of firearm to be held by the mounts 200A and 200B. Sight slots 310A and 310B are slots in the top of the mounts 200A and 200B, which provide clearance for the forward sight in order to allow the top of the firearm slide to abut the top of the slide channels 202A and 202B. Sight slots 310A and 310B are shaped to allow the sight of the particular firearm the mount is designed for, and in some implementations is much larger, or does not exist at all. For example, in a model where the firearm includes an optic rear sight (and no front sight) the sight slot 310A or 310B may be excluded entirely.

Figure 4:
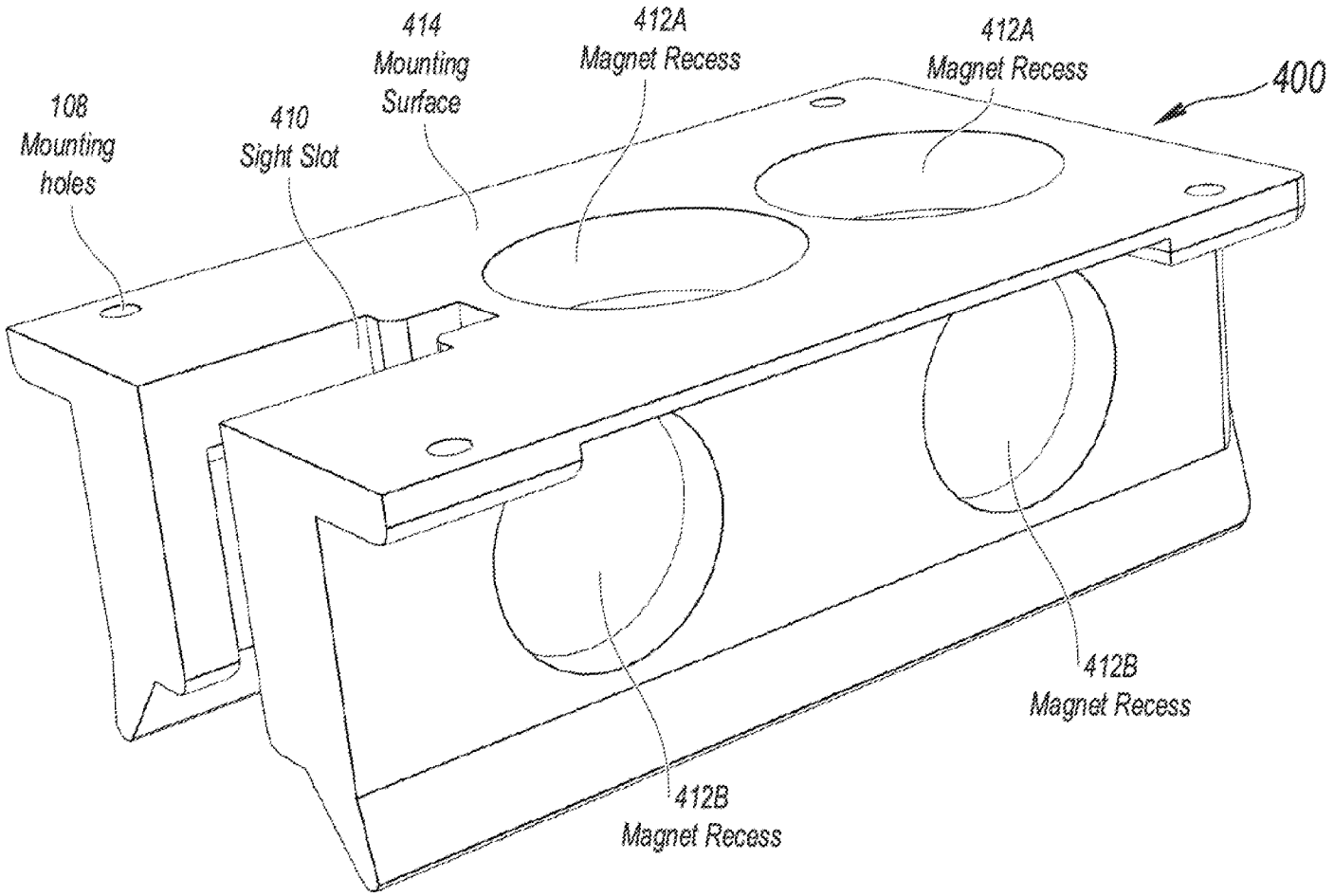
FIG. 4 is a side perspective view of the top and front of an example magnetic firearm mount.

FIG. 4 is a side perspective view of the top and front of an example magnetic firearm mount 400. The top and side of the mount 400 includes recesses for magnets 412A and 412B. The magnet recesses 412A and 412B allow a magnet to be positioned in the mount 400 in order to magnetically couple with the slide of a firearm, securing it in place. While illustrated as circular, magnetic recesses 412A and 412B can be square, rectangular, or any suitable shape for receiving one or more magnets. In some implementations, magnets are affixed into the magnet recesses 412A and 412B using adhesive. In some implementations, the magnets are secured in place using fasteners (e.g., clips, screws, snap covers, etc.). In some implementations, the top of the mount 400 or the mounting surface 414 includes an adhesive mounting strip, which covers the magnet recesses 412A. In some implementations, the side of the mount 400 includes magnetic recesses 412B which can provide additional magnetic fields for holding the slide of a firearm, as well as other accessories. For example, in some implementations, the side of the mount 400 is configured to hold a magazine, and magnets in magnet recesses 412B hold a magazine in place.

In some implementations, mounting surface 414 is positioned on the side of the slide channel, such that the mount 400 can be mounted to a wall or other vertical surface while the firearm is in an upright position.

Figure 5B:
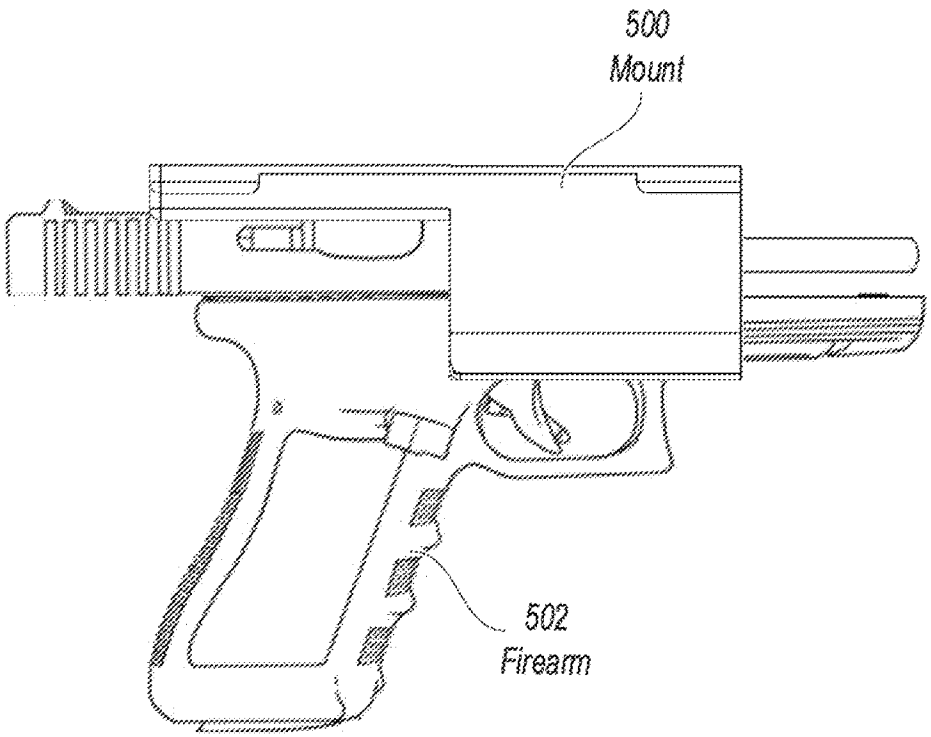
FIGS. 5A and 5B illustrate an example magnetic firearm mount with a firearm secured with the slide in a forward position and a rearward position.
Figure 5A:
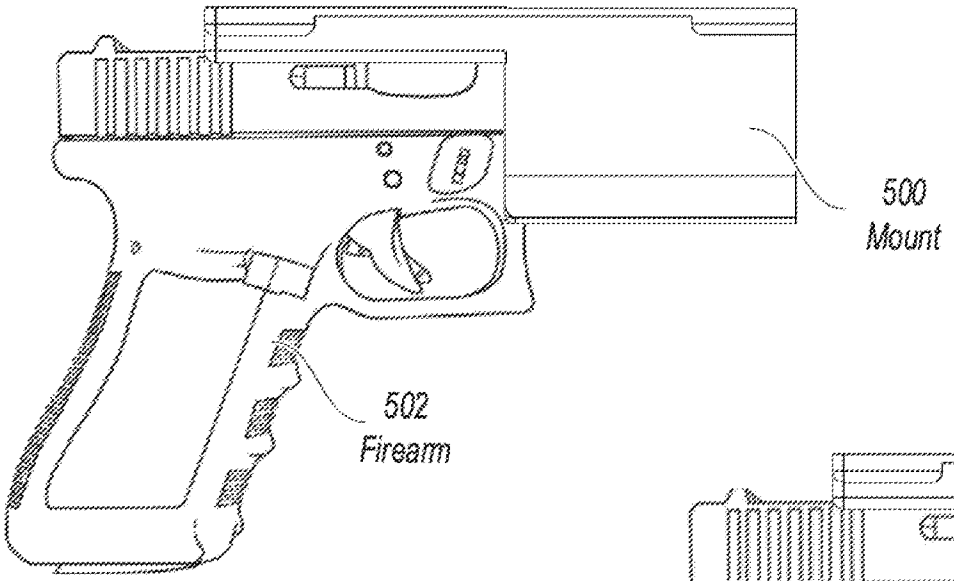

FIGS. 5A and 5B illustrate an example magnetic firearm mount with a firearm secured with the slide in a forward position and a rearward position. In FIG. 5A the firearm 502 is secured in the mount 500 with the slide forward. In some implementations, this is the normal storage position, and the firearm 502 can be in this configuration with a round in the chamber, or empty. Additionally, the magazine can be inserted or not. In FIG. 5B the firearm 502 is secured in the mount 500 with the slide in a rearward position. This configuration can be achieved if the user presses forward on the receiver of the firearm, and can cause a round to be ejected from the chamber. In this position, the user may then withdraw the firearm 502 from the mount 500, and in this manner with a single hand, load and cock the firearm 502 and draw it from the mount 500.

Although this disclosure has been described in terms of certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure.

The invention claimed is:

1. A firearm mount comprising:

a block, a first sidewall, and a second sidewall defining a recess within the block, the recess configured to receive a slide portion of a firearm, the recess being opposite of a mounting surface of the block, the mounting surface configured to be affixed to an external surface;

a slot, defined by the block, at a distal end of the block, the slot sized to receive a barrel of the firearm;

a retaining surface defined by the block, the retaining surface shaped to retain the slide portion of the firearm when the firearm translates towards the slot; and an ejection window, defined by a truncation in the first sidewall, wherein the first sidewall is shorter than the second sidewall, the ejection window sized such that a chambered round is ejected from through the ejection window when the firearm translates toward the distal end of the block.

2. The firearm mount of claim 1, wherein the recess conforms to a shape of the slide portion of the firearm.

3. The firearm mount of claim 1, wherein the block defines a magnet slot on the mounting surface of the block, the slot configured to receive a magnet.

4. The firearm mount of claim 1, wherein the block defines two or more magnet slots on a side of the block perpendicular to the mounting surface and the slot, the magnet slots configured to receive a magnet.

5. The firearm mount of claim 1, wherein the block comprises a single material, the block formed using additive manufacturing.

6. The firearm mount of claim 5, wherein the single material is plastic.

7. The firearm mount of claim 1, wherein the mounting surface defines holes configured to receive mounting hardware.

8. The firearm mount of claim 1, wherein the block defines a notch within the mounting surface configured to receive a front sight of the firearm.

9. A method for cycling a firearm comprising:

placing the firearm in a mount comprising:

a block, a first sidewall, and a second sidewall defining a recess within the block, the recess configured to receive a slide portion of the firearm, the recess being opposite of a mounting surface of the block, the mounting surface configured to be affixed to an external surface;

a slot, defined by the block, at a distal end of the block, the slot sized to receive a barrel of the firearm while retaining the slide portion of the firearm when the firearm translates towards the slot; and an ejection window, defined by a truncation in the first sidewall, wherein the first sidewall is shorter than the second sidewall, the ejection window sized such that a chambered round is ejected through the ejection window when the firearm translates toward the distal end of the block;

translating the firearm toward the distal end of the block, wherein the slide portion is retained by the mount, and the barrel of the firearm passes into the slot; and allowing the firearm to return to battery in the mount.

10. The firearm mount of claim 1, wherein the mounting surface is configured to be detachably removed from the external surface, wherein the external surface is on a base configured to be permanently mounted to a mounting location.

11. The firearm mount of claim 10, wherein the mounting surface is configured to slot into a channel of the external surface.

* * * * *